US007780316B2

(12) United States Patent
Engel

(10) Patent No.: US 7,780,316 B2
(45) Date of Patent: Aug. 24, 2010

(54) BUILT-IN LAMP

(75) Inventor: Hartmut S. Engel, Monrepos Strasse 7, Ludwigsburg (DE) 71634

(73) Assignee: Hartmut S. Engel, Ludwigsburg (DE)

( * ) Notice: Subject to any disclaimer, the term of this patent is extended or adjusted under 35 U.S.C. 154(b) by 517 days.

(21) Appl. No.: 10/539,932

(22) PCT Filed: Nov. 26, 2004

(86) PCT No.: PCT/EP2004/013462

§ 371 (c)(1),
(2), (4) Date: Jan. 25, 2008

(87) PCT Pub. No.: WO2005/066539

PCT Pub. Date: Jul. 21, 2005

(65) Prior Publication Data

US 2008/0266851 A1 Oct. 30, 2008

(30) Foreign Application Priority Data

Dec. 23, 2003 (DE) ..... 103 60 946

(51) Int. Cl.
*F21V 7/00* (2006.01)

(52) U.S. Cl. ..... 362/299; 364/366; 364/346; 364/347; 364/350; 364/355

(58) Field of Classification Search ..... 362/299, 362/364, 366, 346, 347, 350, 355
See application file for complete search history.

(56) References Cited

U.S. PATENT DOCUMENTS

| | | | | |
|---|---|---|---|---|
| 2,244,737 | A * | 6/1941 | Stewart | 362/483 |
| 5,682,131 | A | 10/1997 | Gow | |
| 6,371,621 | B1 | 4/2002 | Le Bel | |
| 7,014,341 | B2 * | 3/2006 | King et al. | 362/296.02 |
| 2002/0024815 | A1 | 2/2002 | Haenen et al. | |
| 2002/0064047 | A1 | 5/2002 | Stauner et al. | |

FOREIGN PATENT DOCUMENTS

| | | | |
|---|---|---|---|
| DE | 2747346 | | 4/1979 |
| DE | 3826676 | A1 | 2/1989 |
| DE | 4336023 | A1 | 4/1995 |
| DE | 4443916 | C1 | 5/1996 |
| DE | 19507333 | A1 | 9/1996 |
| DE | 20119022 | U1 | 4/2002 |
| DE | 10112055 | A1 | 10/2002 |
| DE | 10151958 | A1 | 4/2003 |
| DE | 20310475 | U1 | 10/2003 |
| EP | 0359069 | | 3/1990 |
| EP | 0678700 | A1 | 10/1995 |
| EP | 1033530 | A2 | 9/2000 |
| GB | 548117 | | 9/1942 |
| GB | 1102270 | | 2/1968 |

* cited by examiner

*Primary Examiner*—Jong-Suk (James) Lee
*Assistant Examiner*—Mark Tsidulko
(74) *Attorney, Agent, or Firm*—Gifford, Krass, Sprinkle, Anderson & Citkowski, P.C.

(57) ABSTRACT

The invention relates to a built-in lamp comprising a holder for fastening in an installation surface, in particular in a room ceiling, a bulb fitting and a reflector, wherein the reflector consists of at least a first reflector region which is followed in the direction of illumination by a second reflector region which is releasable from the first reflector region to permit a bulb change.

15 Claims, 3 Drawing Sheets

BUILT-IN LAMP

Figure 1:
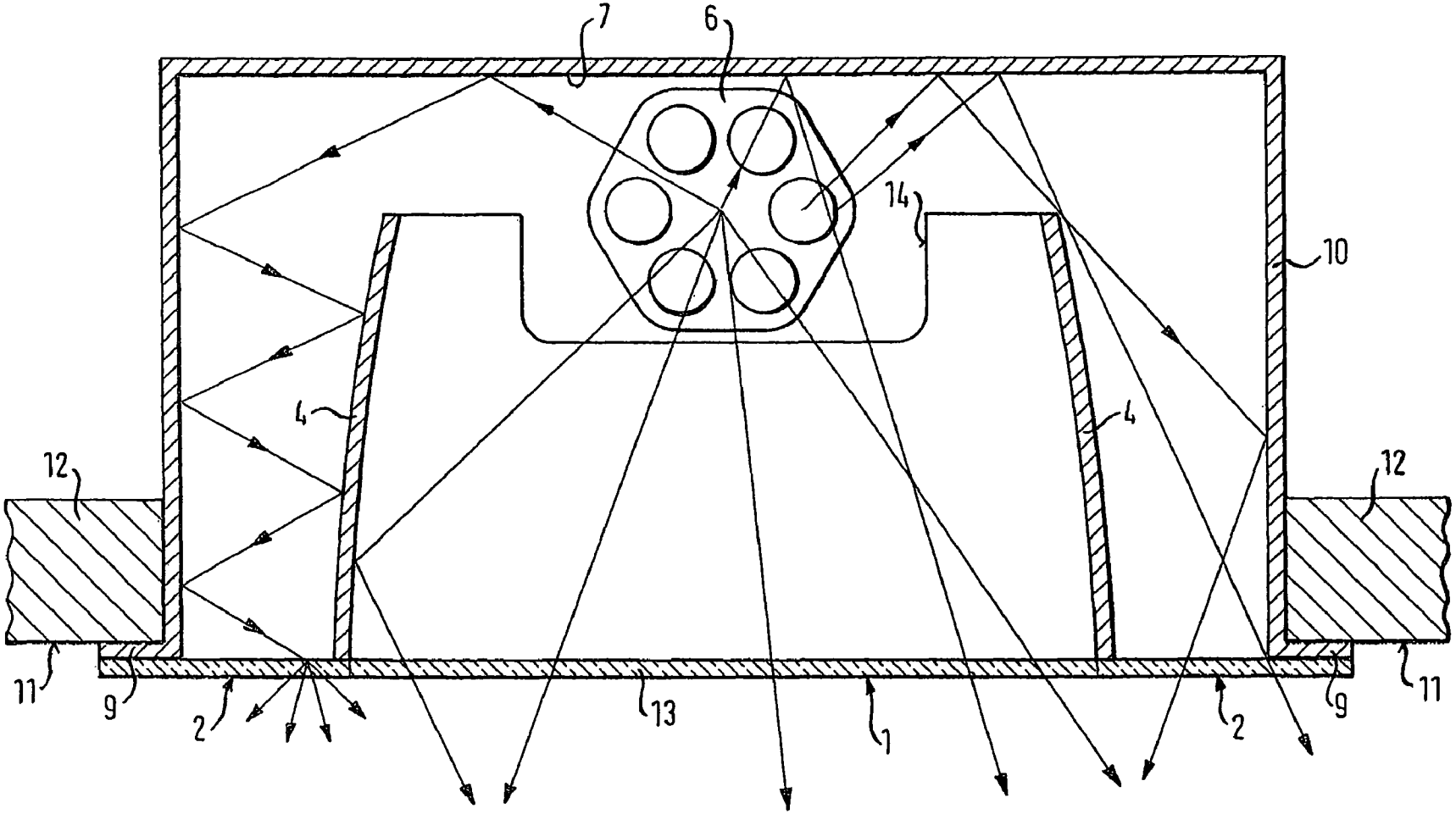

The invention relates to a built-in lamp in accordance with the preamble of claim 1.

Built-in lamps of this kind are known from the prior art in a variety of forms and are available, for example, as downlights or uplights. These built-in lamps frequently have bulb fittings whose longitudinal axes extend perpendicular or obliquely to the direction of illumination or substantially parallel to the installation surface. The named orientation of the bulb fitting is usually selected, in particular on the use of compact fluorescent lamps, since this orientation permits a low installation depth of the lamps.

The orientation of the bulb fitting perpendicular or obliquely to the direction of illumination, however, disadvantageously makes it necessary that the insertion of the bulb into the bulb fitting is difficult due to tight space conditions and that the bulb fitting cannot be ideally positioned relative to the reflector since, in an optimum position, the reflector would be in the way on the insertion of the lamp.

This is remedied in accordance with built-in lamps known from the prior art, for example in that the bulb fitting and a part of the bulb project laterally from the reflector and in that, in many cases, an aperture is provided in the reflector on the side disposed opposite the bulb fitting into which a bulb can be introduced with its side remote from the fitting in order subsequently to permit an insertion of the bulb into the oppositely disposed bulb fitting. The fact is disadvantageous with this embodiment that a aperture must usually be provided in the reflector, which is associated with cost and effort, that the effective reflector is reduced and, moreover, light is permitted to be discharged in a disadvantageous manner through the aperture opposite to the desired direction of illumination.

The named disadvantages, which are typical for downlights known from the prior art, do not occur, in contrast, with surface luminaires from the prior art such as are disclosed in the documents DE 101 12 055 A1 and GB 1 102 270 A. In the surface luminaires described there. the reflector consists at least one first reflector region which is followed in the direction of illumination by a second reflector region which can be released from the first reflector region to permit a change of the bulb.

It becomes possible by this division of the reflector into at least one first reflector region and one second reflector region and by the realeasability of the second reflector region disposed in the direction of illumination from the first reflector region to arrange the bulb mount and the bulb in front of the first reflector region. Accordingly, at least parts of the second reflector region can be arranged in front of the bulb so that the bulb is located so-to-say between the first reflector region and the second reflector region. Due to the releasability of the second reflector region from the first reflector region, the bulb held in the bulb fitting then becomes freely accessible and can be grasped by a person without impediment by the second reflector region and can be released from the bulb fitting of the surface luminaire. With a removed second reflector region, a bulb can likewise be inserted into the bulb fitting without problem and without impediment by the second reflector region.

Finally, that reflection region which was an obstacle on a changing of the bulb with the initially named downlights is therefore released from the built-in lamp or from the remaining reflector region for the purpose of changing, which provides sufficient space to insert a lamp into the bulb fitting or to release a lamp from the bulb fitting. Since therefore a comparatively large working space or access space is available for the changing of a bulb through the removed second reflector region, this procedure can be carried out without problem with the described surface luminaires without, for example, reflector regions being damaged or contaminated.

In accordance with document DE 101 12 055 A1, the first reflector region of the surface luminaire is made as an additional reflector and the second reflector is made as an elongated direct light reflector, with passage regions being located between the additional reflector and the direct light reflector through which a light portion can pass which is ultimately used for the generation of an advantageous, glare-free diffuse illumination. The direct light reflector, in contrast, is acted on directly and immediately by a light portion which is used for the generation of a direct illumination. An elongated reflector of the direct light reflector disposed in the direction of illumination defines a direct light discharge region at whose both sides a respectively diffuse light discharge region is present which is likewise elongated. The diffuse light discharge region is preferably acted on by a light portion which has previously moved through the named light passage region which is formed between the additional reflector and the direct light reflector.

The fact is disadvantageous in the surface luminaire known from the document DE 101 12 055 A1 that it can only be manufactured with a relatively high effort and cost since the two diffuse light discharge regions, which extend at boths sides of the direct light discharge region, have to be made in a complex and costly manner from a respective light-permeable especially shaped element which extends in each case over the total length of the surface luminaire. Each of the two light-permeable especially shaped elements must be separately connected to the lamp housing at a plurality of positions so that the named elements then ultimately form a closed chamber, which cannot be opened easily, together with the housing. The two chambers can consequently only be cleaned while accepting a high effort and cost. Specifically, it is necessary for the cleaning of a surface luminaire in accordance with DE 101 12 055 A1 first to release the direct light reflector from the housing, whereupon then the two light-permeable elements each forming a diffuse light discharge region have to be dismantled.

In addition to the high manufacturing effort and cost, there is consequently also a disadvantageously high maintenance effort and cost. It is moreover of substantial disadvantage that the illumination principle shown in DE 101 12 055 A1 can only be used with surface luminaires, but in contrast not with downlights.

An object of the invention consists of further developing a built-in lamp, which can in particular be used as a downlight, in accordance with the preamble of the new claim 1 in a simple manner such that an economically advantageous manufacture and maintenance of the lamp is even possible when an advantageous, glare-free diffuse light discharge region is present in addition to a direct light discharge region.

This object is satisfied in accordance with the invention by the features of claim 1 and in particular in that the diffuse light discharge region is terminated by a plate which can be released, together with the direct light reflector secured to it, from a housing or from a frame of the built-in lamp.

A unit is provided by the association of the direct light reflector with the plate terminating the diffuse light discharge region which is easy to handle and which can be released or pivoted away from the housing without problem in one single workstep, whereupon all inner regions of the housing are accessible for cleaning purposes and also for the purpose of changing a bulb. No separate chambers are associated with the diffuse light discharge region; it is rather the case that the diffuse light discharge region and the direct light discharge region, which are separate from one another, are provided in a surprisingly simply manner via the association of the plate and the direct light reflector. Consequently, both the manufacturing costs and the maintenance effort can be substantially reduced in accordance with the invention with respect to the prior art. A design of the lamp in accordance with the invention as a downlight is also possible without problem in that the plate and the direct light reflector are given corresponding shapes.

The plate provided in accordance with the invention and connected to the direct light reflector can be designed in the diffuse light discharge region as a scattering plate or, in a more cost-favorable version, as a perforated metal sheet. The plate can cover both the diffuse light discharge region and the direct light discharge region, with it being made transparent in the direct light discharge region in this case. Alternatively, the plate can, however, also be made open.

The design in accordance with the invention of a built-in lamp also permits an optimum relative position between the bulb and all reflector regions beyond the named advantages.

It is preferred for the second reflector region with the plate either to be able to be pivoted away or completely releasable from the first reflector region. When the second reflector region with the plate is only pivoted away from the first reflector region, it is of advantage that the second reflector region with the plate does not have to be handled as a separate part on the changing of a bulb since the second reflector region with the plate is always held a the built-in lamp due to its hinged connection thereto. With a complete releasability of the second reflector region, including the plate, from the built-in lamp, it is, in contrast, of advantage that the latter can be realized with a low economic effort.

The bulb fitting and the first reflector region can preferably be arranged in a housing at which the second reflector region with the plate is hingedly supported and/or to which it can be secured by means of a releasable screw connection, magnet connection, clip connection, latch connection or bayonet connection.

It is advantageous with respect to the housing for it to be made lightproof, since in this case, for example, inexactness in the finishing are not illuminated from behind in an unintended manner with suspended ceilings. The housing can furthermore be made dustproof in order thus to counter contamination of the bulb and reflectors caused, for example, by air-conditioning systems.

The second reflector region can have a reflector opening which is disposed in the direction of illumination and which is terminated in an at least substantially dust-proof manner in a possible embodiment by a translucent or transparent plate. In this manner, a frequent cleaning of the reflector regions and of the bulb can be avoided since the named plate forms reliable protection against dust. Particularly good protection against dust can be achieved if not only the reflector opening is terminated by a plate, but if the total housing is terminated in an at least substantially dust-proof manner by the second reflector region releasably secured to the housing with the plate and/or by elements fixedly connected thereto. In this case, an entry of dust into any housing regions or reflector regions can be reliably avoided.

The first and the second reflector regions can adjoin one another at least sectionally. In this case, the two reflector regions can together adopt the shape of a uniform reflector which is closed on the side disposed opposite the reflector opening. The closed side of the reflector in this case is formed by the first reflector region which is in particular unreleasably connected to the housing. When the first and second reflection regions adjoin one another not only sectionally, but at least almost completely, it is of advantage for one of the two reflector regions to have a section which is open toward the other reflector region and through which the bulb can project laterally into the interior space of the reflector. This section simultaneously permits a releasing of the second reflector region from the first reflector region without the bulb standing in the way of a release of this kind.

The provision of the diffuse light discharge region in accordance with the invention in addition to the direct light discharge region makes it possible to work in accordance with the dark-light principle, which avoids a glare effect, in the direct light discharge region and simultaneously to ensure that non-dazzling scattered light is discharged from the diffuse light discharge region in accordance with the invention around the direct light discharge region, so that a visible marking of the light source which results in a light atmosphere in the room perceived as pleasant despite the use of the dark-light principle.

The direct light discharge region and the diffuse light discharge region can be acted on by a common bulb which can be attached in the bulb fitting.

In this case, no separate bulb has to be provided for the diffuse light discharge region in accordance with the invention.

A pre-settable division of the portion of the reflected light guided to the direct light discharge region and to the diffuse light discharge region can be ensured by the specific shape of the additional reflector. The distribution of the light portions directed to the direct light discharge region and to the diffuse light discharge region can thus be selected in the respectively desired manner by the shape of the additional reflector.

A particularly good diffuse light illumination results when the diffuse light discharge region is acted on only indirectly via the additional reflector by a bulb which can be inserted into the bulb fitting.

The additional reflector can be formed by at least one planar reflector surface which extends parallel to the plane of the installation surface. Alternatively, this reflector surface can also in particular be made to be rotationally symmetrically curved or kinked. The named reflector surface can be made either to be specularly reflecting or diffusely reflecting. It is particularly advantageous for the inner surface of the housing carrying the bulb fitting to be made at least regionally as an additional reflector. When a housing of this kind which is open in the direction of illumination is used, the housing base can in particular be made as a reflector surface which forms at least one region of the additional reflector. The side walls of a housing of this kind can also be made to be specularly reflecting or diffusely reflecting and can thus act as further regions of the additional reflector. When the housing base or the housing side walls are formed as an additional reflector, it is achieved in an advantageous manner that no additional components are required for the additional reflector. It is only necessary to equip the housing with the respectively desired reflection behavior on the inner side.

It is particularly preferred for the housing carrying the bulb fitting to substantially have a parallelepiped shape and for the lamp attachable in the bulb fitting to have an elongate shape, with the longitudinal axis of the bulb fitting extending in a plane extending parallel to the installation surface along a diagonal of the housing of parallelepiped shape. Since the length of this diagonal is dimensioned larger than the length of the side surfaces of the housing, a comparatively large space is available by the named arrangement for the insertion and removal of the bulb by which the named procedures can be handled more simply.

Further preferred embodiments of the invention are recited in the dependent claims.

Figure 2:
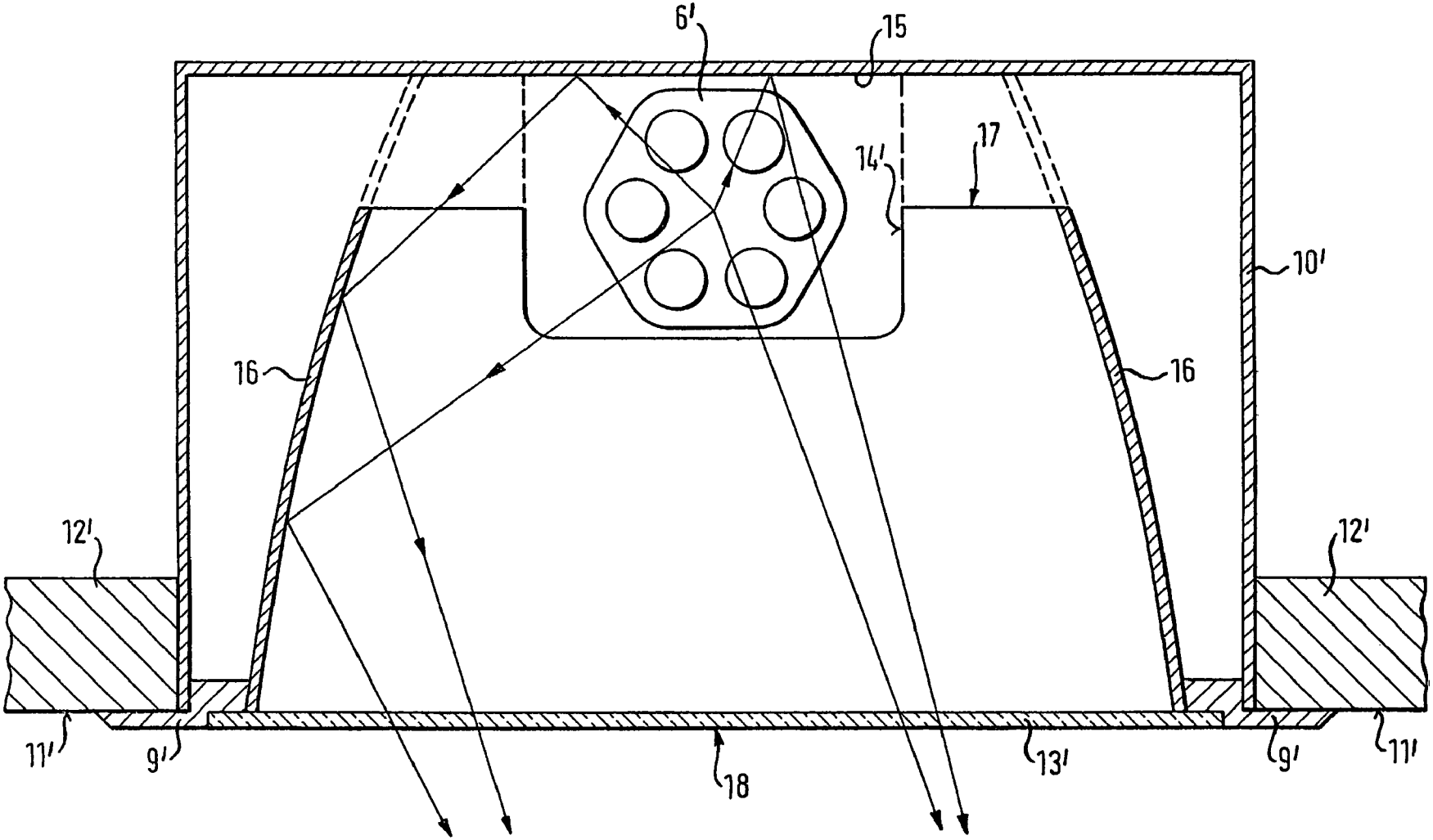
Figure 3:
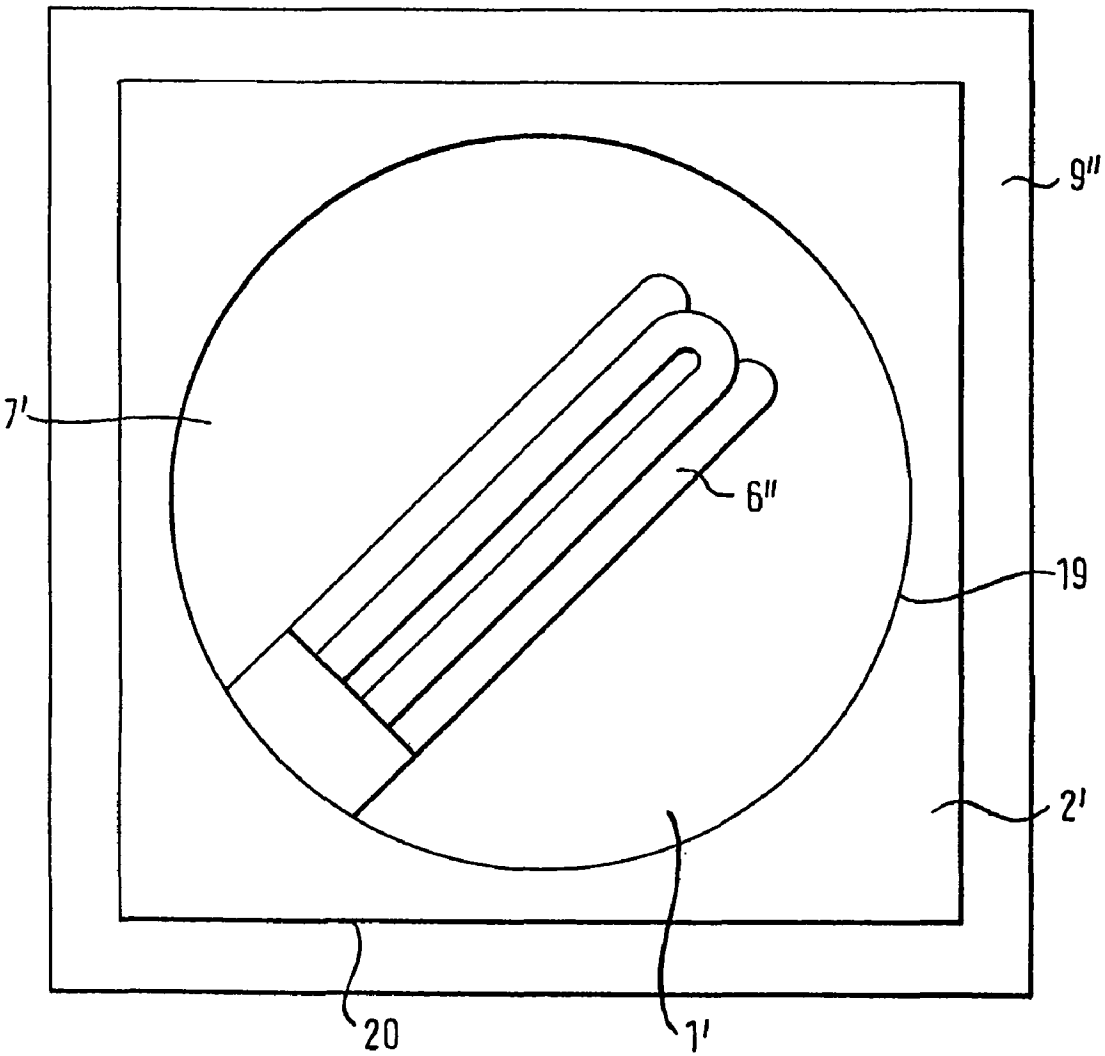

The invention will be described in the following with reference to embodiments and to the drawings. There are shown in these:

FIG. 1 a schematic cross-section through a built-in lamp in accordance with the invention;

FIG. 2 is a view similar to FIG. 1, but illustrating a modification thereof; and FIG. 3 a plan view of a built-in lamp in accordance with the invention in accordance with a further embodiment.

FIG. 1 and FIG. 2 both show a schematic cross-section through a built-in lamp in accordance with the invention.

FIG. 1 shows a schematic cross-section through a built-in lamp in accordance with the invention.

The built-in lamp shown has a housing 10 substantially of parallelepiped shape which is open in the direction of illumination and which has a peripheral frame 9 at its open side. The side of the frame 9 remote from the direction of illumination contacts an installation surface 11 which is formed, for example, by the lower side of a suspended ceiling element 12.

A direct light reflector 4 (FIG. 1) or reflector 16 (FIG. 2) is attached inside the housing 10 and has a first, circular opening in the direction of illumination which coincides with a direct light discharge region 1 (FIG. 1) or direct discharge region 18 (FIG. 2). The direct light reflector 4 forms the second reflector region described above in the sense of the invention. At is end remote from the direct light discharge region 1, the direct light reflector 4 has a further likewise substantially circular opening which faces the base of the housing 10 and from which some of the light amount radiated from the bulb 6 can be discharged from the direct light reflector 4 opposite the direction of illumination in the direction of the housing 10. The direct light reflector 4 has a shape which tapers in the direction of the base of the housing 10 and which, in a possible embodiment, has a cut-out 14 (FIG. 1) or cut-out 14' (FIG. 2) at its end remote from the direct light discharge region 1 in order to provide space for the fitting of the bulb 6.

As shown in FIG. 2, the first reflector 16 adjoins the second reflector 15 as shown in phantom line while a portion 17 of the first reflector 16 is spaced from the second reflector 15.

The base of the housing 10 forms a region of a additional reflector 7. Further regions of the additional reflector 7 are formed by the side walls of the housing 10. The additional reflector 7 forms the first reflector region discussed above in the sense of the invention.

In a possible embodiment, the housing 10 is terminated at its side facing the region to be illuminated by a plate 13 which has different optical properties in different regions. The plate is made completely transparent in the direct light discharge region 1 so that light coming from the bulb 6 can pass through this region without impediment. In the diffuse light discharge region 2, in contrast, the plate 13 is made as a scattering plate which scatters light incident on it from the inner side of the housing and thus generates diffuse light. The region of the scattering plate extends up to the outer edge of the frame 9 so that the frame 9 is covered by the scattered light region of the plate 13.

Alternatively, the plate 13 can also be designed in a more cost-favorable variant as a ring element having apertures, in particular as a perforated sheet with a small perforation size, with it being advantageous in this case for the direct light discharge region not to be made terminated by means of a plate, but to be made open.

In FIG. 1, three light rays originating from the bulb 6 are shown by way of example which are directly incident onto the transparent region of the plate 13 from the bulb 6 and which pass through them without impediment due to the transparence of the plate 13. A further light ray, likewise only shown by way of example in FIG. 1, is incident from the light source 6 onto the specularly reflecting inner side of the direct light reflector 4 from where the light ray is again deflected through the transparent region of the plate 13. An additional light ray, again only shown by way of example in FIG. 1, is incident from the light source 6 at an acute angle onto the additional reflector 7 from where the light ray is likewise deflected through the transparent region of the plate 13. Light rays of the named kind, which pass through the transparent region of the plate 13 and thus through the direct light discharge region 1 provide the room illuminated desired with the built-in lamp in accordance with the invention.

Some of the light supplied by the bulb 6, however, also moves into the light passage region formed between the direct light reflector 4 and the base of the housing 10 so that it can move to the diffuse light discharge region 2 by simple or multiple reflection. A light ray moving to the diffuse light discharge region 2 under multiple reflection is likewise drawn by way of example in FIG. 1 This light ray is incident at a less acute angle starting from the bulb 6 onto the base of the housing 10 and is reflected from there to the side wall of the housing 10. A multiple reflection subsequently takes place between the named side wall of the housing 10 and the specularly reflecting outer side of the direct light reflector 4 until the light ray is ultimately incident onto the region of the plate 13 made as a scattering plate. This scattering light region ensures that the light ray is converted into diffuse light which is discharged from the diffuse light discharge region 2 and marks the direct light discharge region 1 in the manner already explained, which results in the mentioned pleasant light atmosphere in the room. The same applies accordingly to the two light rays in accordance with FIG. 1 which only move to the diffuse light discharge region 2 under reflection at the housing base or by reflection at the housing base and simple reflection at the side wall of the housing.

The plate 13 can be released from the housing 10 or from the frame 9 together with the direct light reflector 4 fastened to it. For this purpose, the plate 13 can, for example, have magnetic elements in its marginal region which cooperate with the frame 9 which is, for example, ferromagnetic. The release of the plate 13 from the frame 9 can then take place simply by a removal of the former, wherein the magnetic forces acting between the named magnetic elements and the frame 9 are overcome. Alternatively, the plate 13 can be held pivotably at the frame 9 and can in particular be secured or latched by means of a clip connection.

The direct light reflector 4 fixedly connected to the plate 13 is also moved out of the housing 10 by the release or pivoting of the plate 13 from the frame 9. The bulb 6, which is now no longer located between the additional reflector 7 and the direct light reflector 4, is subsequently freely accessible so that it can be changed without problem. After the changing procedure, the plate 13 is then moved or pivoted toward the housing 10 again together with the direct light reflector 4 and is magnetically connected or latched thereto.

FIG. 3 shows a built-in lamp in accordance with the invention in a plan view which has a direct light discharge region 1' and a diffuse light discharge region 2' surrounding it (analog to FIG. 1). The direct light discharge region 1' is bounded at its outer periphery by a circular line 19 which at the same time represents the inner boundary of the diffuse light discharge region 2'.

The direct light discharge region 1' extends in the plane of the drawing in the same plane as the opening of a direct light reflector which is disposed in the direction of illumination and which likewise extends along the circular line 19. The direct light reflector extends into the drawing plane up to a rear reflector opening which is disposed opposite to the direction of illumination and which is not shown in FIG. 2.

A bulb 6" is arranged inside the direct light reflector and is designed as an elongate compact fluorescent lamp. Alternatively, the bulb 6" could also be arranged behind or above the direct light reflector.

An additional reflector 7' is provided behind the direct light reflector extending into the plane of the drawing and extends in a plane parallel to the plane of the drawing. The relative arrangement of the direct light reflector, the bulb 6 and the additional reflector 7' is similar to the representation in accordance with FIG. 1.

The diffuse light discharge region 2', which is bounded by the circular line 19 on the inner side, is bounded on the outer side by a square line 20, which in turn forms the inner boundary of a frame 9" of the built-in lamp shown. The side of the frame 9" remote from the direction of illumination contacts an installation surface (not shown), in particular a room ceiling and thus, together with the built-in lamp held in the frame 9", covers an opening present in the installation surface for the reception of the housing of parallelepiped shape of the built-in lamp.

The material difference between the built-in lamp in accordance with FIG. 2 and the built-in lamp in accordance with FIG. 1 consists of the fact that the bulb fitting in which the bulb 6" in accordance with FIG. 2 is held is arranged in the housing such that the bulb 6" inserted into the bulb fitting extends along a diagonal of the housing. The representation in accordance with FIG. 2 illustrates that an optimum and central position of the bulb 6" can thus be achieved within the reflector regions. Moreover, after the removal of the frame 9" together with the direct light reflector from the housing, so much space is available for the changing of the bulb 6" that the bulb 6" can be comfortably removed from or inserted into the bulb fitting.

The invention claimed is:

1. A built-in lamp comprising a housing having an open end and adapted to be secured in an installation surface, a bulb fitting and a first reflector on a top surface of said housing and a second reflector positioned between said first reflector and said open end of said housing, said second reflector releasable from the housing to permit a change of a bulb, wherein said first reflector reflects light around an outer periphery of said second reflector and said second reflector forming a direct light reflector, and wherein a reflector opening of the direct light reflector disposed in the direction of illumination defines a direct light discharge region which is surrounded at least regionally by a diffuse light discharge region, characterized in that a plate extends between said second reflector and said housing and covers the diffuse discharge region, said plate being attached to said second reflector so that said second reflector and said plate are removable from the housing as a unit to provide access to the bulb for changing the bulb.

2. A built-in lamp in accordance with claim 1, characterized in that the plate comprises a light scattering plate.

3. A built-in lamp in accordance with claim 1, characterized in that the plate covers both the diffuse light discharge region and the direct light discharge region, with it being made transparent in the direct light discharge region.

4. A built-in lamp in accordance with claim 3, characterized in that the second reflector region has a reflector opening which is disposed in the direction of illumination and which is terminated in a substantially dust-proof manner by said plate.

5. A built-in lamp in accordance with any one of the claims 1 or 2, characterized in that the direct light discharge region is made open.

6. A built-in lamp in accordance with claim 1, characterized in that the second reflector region together with the plate is pivotal away from and completely releasable from the housing.

7. A built-in lamp in accordance with claim 1, characterized in that the bulb fitting and the first reflector region are arranged in a housing which is light-proof and dust-proof and at which the second reflector region with the plate is hingedly supported or to which it can be fastened by means of a releasable fastener.

8. A built-in lamp in accordance with claim 7, characterized in that the housing is terminated in a substantially dust-proof manner by the second reflector region releasably secured together with the plate to the housing.

9. A built-in lamp in accordance with claim 7, characterized in that the housing, substantially has a parallelepiped shape, the bulb having an elongated shape, with the longitudinal axis of the bulb fitting extending in a plane extending parallel to the installation surface along a diagonal of the housing of parallelepiped shape.

10. A built-in lamp in accordance with claim 1, characterized in that the first and second reflector regions adjoin one another sectionally.

11. A built-in lamp in accordance with claim 1, characterized in that a light passage region is formed between the additional reflector and the direct light reflector.

12. A built-in lamp in accordance with claim 1, characterized in that a single bulb in said bulb fitting illuminates both the direct lid it discharge region and the diffuse light discharge region.

13. A built-in lamp in accordance with claim 1, characterized in that said bulb illuminates the diffuse light discharge region only indirectly via the additional reflector by a bulb attachable in the bulb fitting.

14. A built-in lamp in accordance with claim 1, characterized in that the first reflector is formed by at least one reflector surface which ensures a pre-determinable splitting of the portion of the reflected light directed to the direct light discharge region and to the diffuse light discharge region.

15. A built-in lamp in accordance with claim 1, characterized in that the second reflector has a cut-out for a passage of the bulb attachable in the bulb fitting.

* * * * *